US006626431B2

(12) United States Patent
Possidento

(10) Patent No.: US 6,626,431 B2
(45) Date of Patent: Sep. 30, 2003

(54) ROTATIONAL CUBIC PUZZLE

(76) Inventor: William Possidento, 27 Spicer Rd., Westport, CT (US) 06880-4528

( * ) Notice: Subject to any disclaimer, the term of this patent is extended or adjusted under 35 U.S.C. 154(b) by 0 days.

(21) Appl. No.: 09/866,057

(22) Filed: May 29, 2001

(65) Prior Publication Data

US 2002/0180149 A1 Dec. 5, 2002

(51) Int. Cl.[7] ..... A63F 9/08

(52) U.S. Cl. ..... 273/153 S

(58) Field of Search ..... 273/153 K, 157 R, 273/153 S, 156

(56) References Cited

U.S. PATENT DOCUMENTS

| | | | | | |
|---|---|---|---|---|---|
| 3,565,442 | A | * | 2/1971 | Klein | 273/157 R |
| 3,638,949 | A | * | 2/1972 | Thompson | 273/157 R |
| 4,593,907 | A | * | 6/1986 | Abu-Shumays et al. | 273/153 S |
| 5,156,548 | A | * | 10/1992 | Grafflage | 273/153 R |

* cited by examiner

*Primary Examiner*—Steven Wong
(74) *Attorney, Agent, or Firm*—John P. Halvonik

(57) ABSTRACT

A rotating cubic puzzle having 6 faces in the manner of Rubik's Cube (trademark name for cubic puzzle) and having an N×N array of cells on each face. Each cell of the puzzle has a numerical value associated with it such that when the puzzle is successfully solved, the numerical values of any row, column or "space diagonal" will add up to the same number.

1 Claim, 3 Drawing Sheets

| | | |
|---|---|---|
| 8 | 1 | 6 |
| 3 | 5 | 7 |
| 4 | 9 | 2 |

FIG. 1

| | | | |
|---|---|---|---|
| 1 | 12 | 8 | 13 |
| 15 | 6 | 10 | 3 |
| 14 | 7 | 11 | 2 |
| 4 | 9 | 5 | 16 |

FIG. 2

| | | | | |
|---|---|---|---|---|
| 15 | 8 | 1 | 24 | 17 |
| 16 | 14 | 7 | 5 | 23 |
| 22 | 20 | 13 | 6 | 4 |
| 3 | 21 | 19 | 12 | 10 |
| 9 | 2 | 25 | 18 | 11 |

FIG. 3

| | | | | | | | | |
|---|---|---|---|---|---|---|---|---|
| 10 | 26 | 6 | 23 | 3 | 16 | 9 | 13 | 20 |
| 24 | 1 | 17 | 7 | 14 | 21 | 11 | 27 | 4 |
| 8 | 15 | 19 | 12 | 25 | 5 | 22 | 2 | 18 |
| top row | | | middle row | | | bottom row | | |

FIG. 4

ROTATIONAL CUBIC PUZZLE

FIELD OF THE INVENTION

The invention relates to the field of puzzles and in particular to a mathematical puzzle in form of a cube with rotatable sections, whose goal is to rotate the pieces of the cubic puzzle so as to complete a "Magic Square" on each of the six faces of the puzzle.

The physical components of the puzzle include a cubic rotatable block type of puzzle that in its simplest form (a 3×3 array on each of the six faces) would be comprised of 27 individual sections. 26 of the sections are visible and the 27th is the core section in the center of the puzzle upon which the other sections rotate. Other means to achieve the rotation of the core section may be used without varying from the spirit of the invention.

This underlying structure may be described by reference to the RUBIK'S CUBE, (trademarked name for cubic puzzle) which would have the same number of rotating sections (26) that this puzzle would have in its simplest form. Moreover, the underlying physical construction of a center section in connection with the peripheral sections suggests that this sort of construction can be used in the present invention. There may be more sections (for higher order arrays, e.g. 4×4 and 5×5) but the underlying principle of a central section in connection with the peripheral sections that allow sections of the puzzle to move together would be established.

Each face of the puzzle is divided into 9 sections; in the case of Rubik's Cube, the 9 sections are supposed to all be of the same color when the puzzle is solved correctly. In the case of the invention herein, the 9 sections will form a "magic cube" when the sections are correctly lined up which means that all of the cells in the array on each of the six faces will add up to the same number. The cells will add up orthogonally (up/down or left/right) as well as diagonally "in space", see below.

BACKGROUND OF THE INVENTION

It is first necessary to define what is meant by a magic cube for purposes of this invention and to determine what will constitute completing the puzzle.

W. S. Andrews first defined a magic square as a series of numbers so arranged in a square that the sum of each row and column and of both the corner diagonals shall by the same amount which may be termed the summation. (W. S. Andrews, Magic Squares and Cubes, 2nd edition, Dover Publication Inc. New York, 1917, p 1)

Martin Gardner defined a standard magic square as;

" . . . a square array of positive integers from 1 through $N^2$ arranged so that the sum of every row, every column, and each of the two main diagonals is the same. N is the "order" of the square. It is easy to see that the magic constant is the sum of all the numbers divided by N. The formula is;

$$(1+2+3 \ldots +N^2)/N=\tfrac{1}{2}(N^3+N)$$

The trivial square of order 1 is simply the number 1 and of course it is unique. It is equally trivial to prove that no order-2 square is possible" (Martin Gardner, Time Travel and Other Mathematical Bewilderments, W H Freeman and Co. New York, 1988, p 214.

By way of illustration; FIG. 1 shows a 3×3 magic square. The sum of the numbers of any row column or diagonal (a diagonal drawn through the center cell) adds up to 15. Note also that the sum of any two opposite numbers (e.g. 3 and 7 in this example) in the magic square is 10 which is twice that of the center number (5 in this case) or $N^2+1$.

FIG. 2 shows an example of a 4×4 magic square where the sum of any column, row or corner diagonal is 34. The sum of two opposite numbers is 17 which is the sum of the first number (1) and last number (16) of the series in this case.

FIG. 3 shows a 5×5 magic square. Again with the same properties when the columns, rows and diagonals are added up. The sum of two opposite numbers is twice that of the center number or $n^2+1$.

As it turns out however, such magic squares do not exist that meet, precisely, these requirements when we move to three dimensional arrays. I.e. arrays that are arranged in space so that one can sum them up along different dimensions.

Again Gardner

"It is natural to extend the concept of magic squares to three dimension and even higher ones. A perfect magic cube is a cubical array of positive integers from 1 to $N^3$ such that every straight line of N cells adds up to a constant. These lines include the orthogonal and two main diagonals of every orthogonal cross section and the four space diagonals. The constant is;

$$(1+2+3 \ldots +N^3)/N^2=\tfrac{1}{2}(N^4+N)$$

"There is of course, a unique perfect cube of order 1 and it is trivially true that there is none of order 2. Is there one of order 3? Unfortunately, 3 does not quite make it . . . Annoyed by the refusal of such a cube to exists, magic cube buffs have relaxed the requirements to define a species of semi-perfect cube that apparently does exist in all orders higher than 2. These are cubes where only the orthogonals and four space diagonals are magic. Let us call them Andrews cubes since W. S. Andrews devotes two chapters to them in his pioneering Magic Squares and Cubes." (1917). The order 3 Andrews cube must be associative, with 14 in its center. There are four such cubes, not counting rotations and reflections. All are given by Andrews, although he seems not to have realized that they exhaust all basic types. (Gardner, Time Travel and Other Mathematical Bewilderments, p. 219).

It is with respect to this type of "Andrews Cube" that Gardner refers to that we will refer to as a "Magic Cube" for purposes of this invention. Note that this means that only the orthogonals (rows and columns illustrated by arrows 7/8 in FIG. 8) and the four "space diagonals" (arrow 3 in FIG. 8) meet the definition of the sums being the same. Ordinary diagonals (as one goes in a diagonal direction across the face of the cube) will not necessarily sum to the same number.

Note in contrast to "ordinary diagonals" that a "space diagonal" means a line drawn from a corner cell through the imaginary center (note again the center section is not visible to the player) and continuing in a straight line till it reaches the corner section that is opposite from the corner we started at. See arrow 3 running through the center of the 3×3×3 cube in FIG. 8 and having end points in a corner cube for a total of three numerical values.

There are four such center based, "space diagonals" in a cube and in a 3×3 array, this space diagonal must have 3 numbers that are summed together (just like the orthogonals in a 3×3×3 cube). Two of the numerical values corresponding to the corner sections of the puzzle and the other value corresponding to an imaginary center section for a total of three numberes to produce the "magic sum." (A "corner section" means like cubic section 1 in FIGS. 6/8)

The numerical value of the "center core" section may be imagined by the user because it cannot be seen when the puzzle is in normal use, and hence, there is no need to physically put a numerical value on that piece of the puzzle.

The same sort of relation holds with respect to 4×4×4 and higher order arrays. In the case of a 4×4×4 cube, the central core that cannot be seen will form a 2×2×2 cube (i.e. inside the larger 4×4×4 cube). See FIG. 9; 5 denotes the "central core" (normally unseen by the user).

The space diagonal in the 4×4×4 will thus cut through the center of this 2×2×2 core and thereby hit two members of the smaller 2×2×2 cube. So the same relationship holds, as above, only this time we will use four numbers to be summed up. This is true for each space diagonal as well as the orthogonals.

The same is true for 5×5×5 arrays with the central core in this case being 3×3×3 cube that is unseen by the user. In this case, a space diagonal will start/end at the two corners of the 5×5×5 and three cubes from the central 3×3×3 core will together form another space diagonal. This time the total number of numbers to be summed in the diagonal is 5. (as it would be for an orthogonal in a 5×5×5)

Note that in this puzzle, all of the faces on a given smaller section (out of the 26 smaller sections that comprise a larger 3×3×3 cube) may be imagined as having the same number printed on each face of the smaller section. Obviously, many of the faces of the smaller sections are not seen by the user (e.g. 4 of the six faces of a side section 2 in FIGS. 6/8 cannot be seen by the user) but those that are seen must have the same number on each face in order for the puzzle to work.

In the case of those corner sections of the puzzle (shown by 1 in FIGS. 6/8) there are three faces of the smaller cube that are visible to the user. One for each face of the cube that this corner section forms a part of. Thus, each visible face of this smaller cubic section would have the same numerical designation upon it.

See for example the corner section marked with indicia "18" in FIG. 5 and the side section marked with indicia "4" in FIG. 5. All three visible faces of the corner section must have the numeric indicia "19" and both visible faces of the side section must have the number "4" for the puzzle to work.

What is very interesting is that even those cubes that form the "central cores" must necessarily have the same number on all those faces that are used to form the space diagonals that run through them.

SUMMARY OF THE INVENTION

The invention is a cubic puzzle having 6 faces and an N×N array of cells on each face. Rotatable sections form the cells of the puzzle and the rotatable sections are in connection with a central section which cannot be seen when in normal use. Each cell of the puzzle has a numerical value associated with it such that when the puzzle is successfully completed the values of any row, column or "space diagonal" will add up to the same number.

In the case of a 3×3 puzzle there are 26 rotatable sections in order to comprise 6 faces, each with a 3×3 array on each face. In the case of a 4×4 puzzle there are 56 rotatable sections. And with corresponding numbers of sections for puzzles of higher orders. Such puzzle sections may be rotatable by means of a connection between the outer visible sections and an inner core, in the manner of Rubik's Cube. Those sections of the puzzle that have more than one face that is visible to the user will have the same numerical value associated with each face of the section.

It is an object of the invention to provide a 3×3 cubic puzzle having a total of 27 sections, of which 26 are rotatable, and where each of the rotatable sections have a numerical designation upon them so that the puzzle can be rotated so as to complete an Andrews type 3×3 magic square on each of the six faces of the puzzle.

Another object of the invention to provide a cubic puzzle of an order N×N, having rotatable sections, and each section having a numerical designation so that the puzzle can be rotated so as to complete an Andrews type N×N magic square on each of the six faces of the puzzle.

Other objects and advantages will be seen by those skilled in the art once the invention is shown and described.

DESCRIPTION OF DRAWINGS

FIG. 1 illustration of a 3×3 magic square;

FIG. 2 illustration of a 4×4 magic square;

FIG. 3 illustration of a 5×5 magic square;

FIG. 4 an Andrews cube where each facial array has been broken down,

DESCRIPTION OF THE PREFERRED EMBODIMENT

Figure 5:
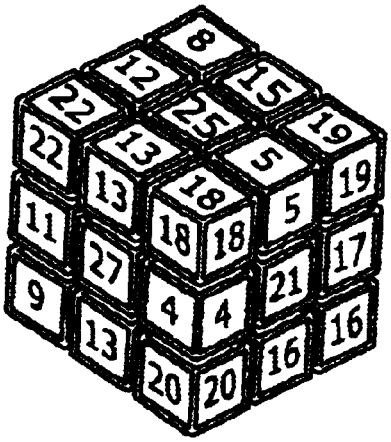
FIG. 5 a 3×3×3 solved puzzle.

The overall view of the puzzle is shown in FIG. 5. Each face of the cube is comprised of a 3×3 array created by the various sections that make up the puzzle. In this case, the summation of a solved puzzle would be 42; that is each column, row and space diagonal adds up to 42 when the puzzle is solved.

Each of the various sections of the puzzle contain a unique number such that when the puzzle is completed all the rows, columns and space diagonals of the puzzle will add up to the same number. It is for the user to determine what that number is and to rotate the sections and put them back to where the puzzle is complete. It is also possible that the puzzle may come with a set of instructions that tell the user what the final "answer" will be, i.e what the actual sum is that solves the magic square for all the columns, rows, etc.

Figure 6:
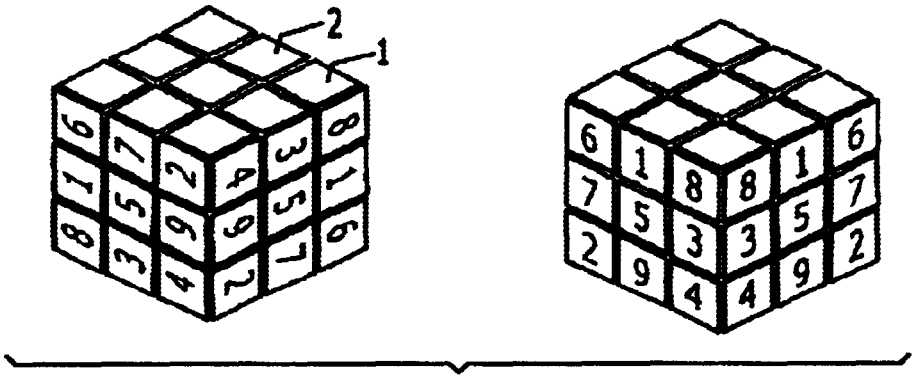
FIG. 6 magic squares on the faces of Rubik's cubes.
Figure 7:
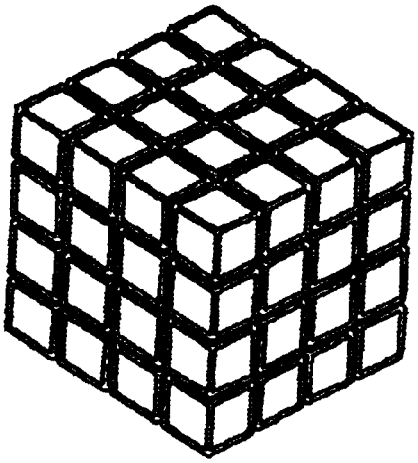
FIG. 7 Meffert's 4×4×4 Master cube.
Figure 8:
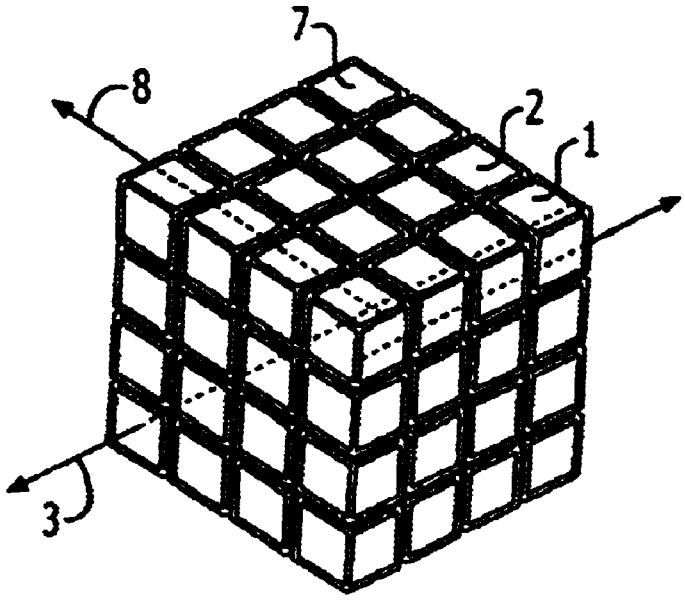
FIG. 8 depicts the orientation of a "space diagonal;"
Figure 9:
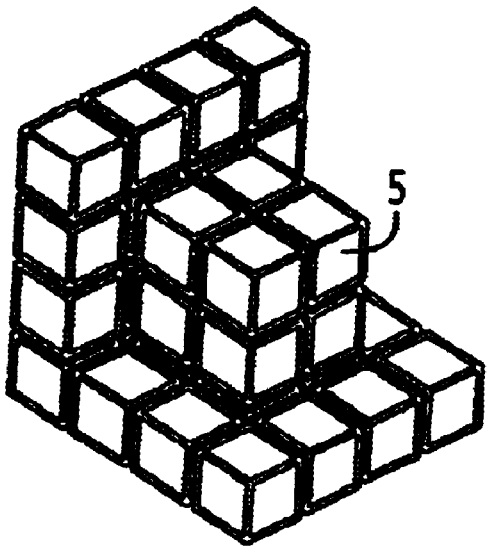
FIG. 9 cut away view of a 4×4×4 cube showing the central 2×2×2 array.

Again, note that any section that forms more than one face, (i.e. corner sections that form part of three faces, and side sections that form a part of two faces) will have the same number on each of its faces. FIG. 6 depicts side section 2 and cubic section 1.

When we refer to "sections" we mean those smaller pieces that comprise the puzzle. A cubic puzzle with a 3×3 array on each face will have a total of 26 sections. As one views any given face he will see a 3×3 array comprised of 9 small sections. There are 26 visible sections (and not 27) in a 3×3 array since the last section is actually inside the puzzle and cannot be seen by the user. It physically does exist since it is used to keep the sections together so they may rotate together when the puzzle is moved.

Again the mechanics of the puzzle are state of the art and need not be described in any great detail as those skilled in the art may be able to discern the construction. Suffice to say that the well known, Rubiks' Cube offers one straightforward way of creating a cubic puzzle with rotatable sections. In that case, a 3×3 type of cube has 26 sections arranged upon a central section that is unseen by the user. The various sections rotate as groups due to the connection that they all have with the central section.

FIG. 4 breaks down the arrays of a sample 3×3 cube in an idealized form, so that we can see 3 separate 3×3 arrays. One may then imagine these arrays as forming a cubic surface when they are aligned with one another. Note that in this case, the idealized version of FIG. 4 does not depict literally what the user sees.

That is to say, that the first section in FIG. 4 will indeed be what the user sees on the front face of the cube. Keeping this convention in mind (i.e. with the front face designated as aforementioned) then the third section shown in FIG. 4 will be the rear face, or that face opposite the front face. However, the top face of the cube will actually be an array comprised of the top row of each of the three arrays, and the bottom face will be the lower row of each of these three arrays. And so forth for the left and right faces of the cube.

So the idealized version in FIG. 4 shows literally what two of these faces will look like to the user (when the puzzle is solved) but the other four faces will draw on parts of these arrays. Thus this version is best imagined as being in space with the user's imagination able to join these 3 arrays into one giant 27 section array.

Recall that there are only 26 visible sections in a 3×3 cubic array puzzle. Note then, that the "central core" in FIG. 4, i.e. the number "14" in this set of arrays will actually not be seen at all by the user. This is the imaginary central section, that cannot be seen by the user, and that is necessary if the user is to sum the "space diagonals" of the puzzle and get these diagonals to sum correctly. I.e to add up to 42 to solve this particular puzzle.

It is believed that 42 is the simplest solution to a 3×3 cubic array such as this and it is preferred that the numbers shown in FIG. 4 be the solution set to the 3×3 puzzle. However without being bound by theory and without limiting the invention, other arrays of numerical values may also be used without departing from the spirit of the invention. Provided of course, that when in the solved state, the columns, rows and space diagonals will all add to the same number.

The same reasoning goes for 4×4 and higher order arrays. There are likely multiple solution sets to these arrays any or all of which may find use in the invention.

The puzzle may come with the cube already in the solution state, i.e. where the sum of all the columns, and rows of each face, as well as the four space diagonals of the cube is the same. Or it may come unsolved. In any event, to start the puzzle, the sections are rotated so that the puzzle is not solved. The user will then rotate the sections of the puzzle (in the same way as Rubik's Cube) in order to rearrange the sections so that the puzzle will be solved.

When the puzzle is rotated in one direction, a group of 9 sections will rotate by virtue of their connection with the central section. When the puzzle is rotated in a different direction another group of 9 sections will rotate as one. The 9 sections may be the same 9 sections as before or they may be a different set of 9 sections.

The puzzle may come in 3×3×3 arrays on each face, or 4×4×4 or 5×5×5 or perhaps higher orders depending on such things as consumer demand and the efficacies of manufacturing such higher order cubes. Of course, with higher order arrays, a movement of the puzzle will move more sections. Thus, a 4×4 array will move 16 sections (in all in the same plane) when the puzzle is rotated by the player. A 5×5 will move 25 sections when the puzzle is rotated.

It is thought the puzzle may be manufactured out of plastic although other materials are possible without varying from the spirit of the invention.

I claim:

1. A cubic shaped puzzle having 26 sections each of said sections being independently connected to a single central section such that rotation of a portion of said puzzle will result in certain 3×3 arrays of said sections moving in alignment with each other, said sections forming a cubic surface having six faces, and said sections including eight corner sections that define the corners of said cubic surface at any one time; each of said faces comprising a 3×3 array of sections, each of said sections having a numerical value in association with at least one face of said section, such that when said puzzle is solved, the sum of each column and row of each of said 3×3 arrays will sum to a magic number; said puzzle having four space diagonals; each of said space diagonals comprising two of said corner sections aligned opposite one another and a central piece, said central piece being unseen and associated with the Position of said central section; said central piece having a central number associated with it such that when said central number is summed with said numerical values associated with said corner sections, the numerical value will be the same as said magic number.

* * * * *